US006131210A

United States Patent [19]

Coca

[11] Patent Number: 6,131,210

[45] Date of Patent: Oct. 17, 2000

[54] VENTILATED MOBILE HOME TOILET

[76] Inventor: Abenicio Alphonso Coca, 1950 N. Carson, # 69, Carson City, Nev. 89702

[21] Appl. No.: 09/275,348

[22] Filed: Mar. 22, 1999

[51] Int. Cl.[7] ..... E03D 3/04

[52] U.S. Cl. ..... 4/213; 4/216

[58] Field of Search ..... 4/213, 211, 216, 4/217, 218, 209 R, 210, 209 EF, 306, 472, 475, 477, 482

[56] References Cited

U.S. PATENT DOCUMENTS 5,388,280 2/1995 Sim ..... 4/213

FOREIGN PATENT DOCUMENTS 1578-436 11/1980 United Kingdom ..... 4/213

*Primary Examiner*—Henry J. Recla
*Assistant Examiner*—Huyen Le
*Attorney, Agent, or Firm*—Charles Hartman

[57] ABSTRACT

Toilets are ventilated with an apparatus wherein a first aperture defined by a hollow toilet body positioned near the back side of the seat of the toilet and a second aperture defined by the hollow toilet body located in the rear wall of the hollow toilet body are joined by a tube penetrating the first and second apertures to place a first end of the tube near the seating area of the toilet. The tube continues through the wall of the mobile dwelling and is joined to a blower mounted outside and connected to the second end of the tube. An electric switch in electrical communication with the blower, mounted near the seating area of the toilet.

7 Claims, 2 Drawing Sheets

VENTILATED MOBILE HOME TOILET

BACKGROUND OF THE INVENTION

1. Field of the Invention

This invention relates to toilets and to the ventilation thereof; in particular, this invention relates to toilets used in mobile homes and recreational vehicles; and, more particularly, this invention relates to the ventilation of toilets used in mobile homes and recreational vehicles by using air circulation devices ventilatively connected to the toilet and having direct outside access from the enclosed mobile dwelling.

2. State of the Art

It is widely known that bathrooms seem to be an unending source of unpleasant, noxious and even unhealthful odors. Those who must live in proximity to bathrooms, in, for example, adjacent bedrooms will, at least on occasion, desire that the bathroom be ventilated. In recreational vehicles, mobile homes and the like, the compactness of the mobile dwelling and the resultant close proximity of all the interior of the mobile dwelling to every other portion of the interior makes the entire living quarters susceptible to an objectionable olfactory assault from the bathroom. One solution to the problem created by such assault is, after the objectionable odors are detected, the occupants vacate the premises for a while. That is, in essence, to sit on the porch while the odors disparate. But this fairly poor solution is obviously impractical during winter or other sorts of foul weather. Since more and more people now live in mobile dwellings as their primary residences, an effective solution to the special odor problem created in these compact living quarters is important.

A wide variety of possible solutions to the problem of odor from the bathroom have been tried, but the problem persists. Solutions for the generic problem of odors from toilets typically address the problem created by the larger toilets found in free standing homes and similar structures, and include various ventilation apertures in the toilet seat vented to the outside, either the roof or the side of the structure. These solutions require seats with a substantial depth, that is the dimension from the toilet to the seating surface must be large enough to house the plumbing required by the seat lid to adequately ventilate the toilet. In the toilets used in mobile homes, recreational vehicles and the like, hereinafter referred to as mobile dwellings, the toilet seat tends to have nearly dimension-less thicknesses. The toilet seats in these toilets are frequently a single piece of shaped sheet plastic that fits over the bowl of the specialized toilet. Moreover, the mobile dwellings most in need of odor control are the smaller more compact models; the smaller, the more critical the need. Of course, these smaller mobile dwellings are precisely the models where the use of bulky add-on apparatus to the existing structure or the need for massive reconstruction of the mobile dwelling to accommodate new structures are the most prohibitive.

SUMMARY OF THE INVENTION

This invention provides toilets ventilated with an apparatus wherein a first aperture defined by a hollow toilet body positioned near the back side of the seat of the toilet and a second aperture defined by the hollow toilet body located in the rear wall of the hollow toilet body are joined by a tube penetrating the first and second apertures to place a first end of the tube near the seating area of the toilet. The tube continues through the wall of the mobile dwelling and is joined to a blower mounted outside and connected to the second end of the tube. An electric switch in electrical communication with the blower, mounted near the seating area of the toilet.

A first aspect of this invention is a toilet ventilation apparatus comprising:

- a toilet body located inside a mobile vehicle having a front, rear, top and bottom, and a bowl defined by a surface of a first shaped member and an outside surface defined by a second shaped member, the first member separated from the second member by a gap, the first member and the second member joined at the top of the toilet body to form a flat top surface;
- a first aperture defined by the flat top surface and positioned near the back side of the seat of the toilet;
- a second aperture defined by the second member and located in the rear wall of the hollow toilet body;
- a tube having a first end and a second end penetrating the first aperture and the second aperture placing the first end of the tube near the seating area of the toilet between the position of the toilet seat in the sitting position, and the flat top surface;
- an outlet to the outside of the mobile vehicle;
- a blower mounted on an outside surface of the mobile vehicle and connected to the second end of the tube, the tube providing a means of vapor communication between the toilet bowl and the outside of the mobile vehicle; and
- an electric switch in electrical communication with the blower, mounted near the seating area of the toilet.

A second aspect of this invention is a system for removing odors from a mobile home toilet or the like comprising:

- a mobile or movable structure housing a toilet;
- the toilet including a toilet body located inside a mobile vehicle having a front, rear, top and bottom, and a bowl defined by a surface of a first shaped member and an outside surface defined by a second shaped member, the first member separated from the second member by a gap, the first member and the second member joined at the top of the toilet body to form a flat top surface;
- a blower mounted externally to a structure housing a toilet, the blower being electrically actuated by the user of the toilet at the beginning of the user's use, proximate in time to when the user sits on the toilet; and
- a vapor communication conduit connecting the blower and the toilet, the conduit leading to the rear of the toilet held in place by snap fitting into a fixture into the blower, passing to the toilet through the wall of the vehicle, penetrating the outside surface of the toilet bowl, passing through the gap in the toilet body, and penetrating the toilet body at the flat top surface.

DETAILED DESCRIPTION OF THE PREFERRED EMBODIMENT

Figure 1:
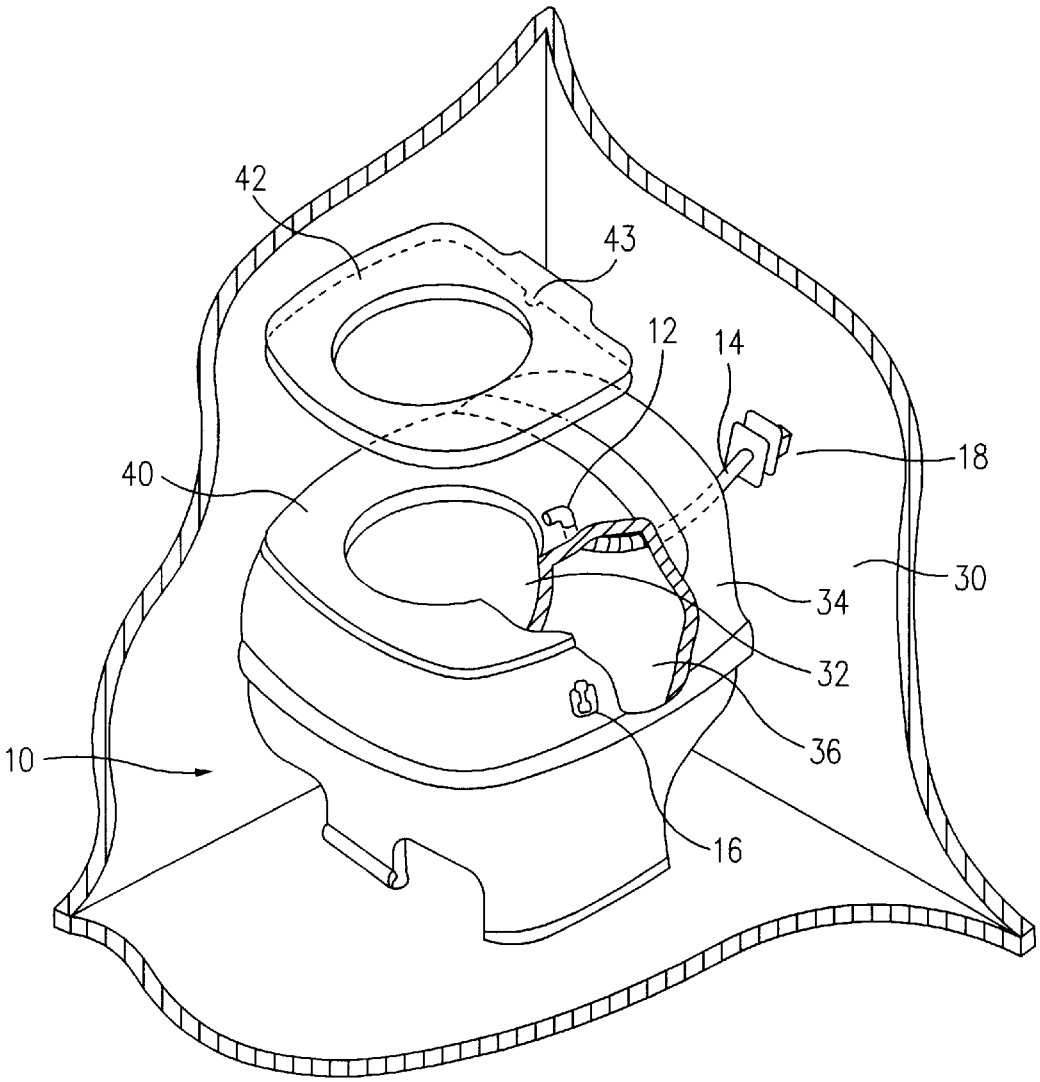
FIG. 1 is a perspective view, partially cut away, and partially exploded, showing the toilet used in one embodiment of the present invention connected to the wall of the bathroom or the floor of the trailer behind the toilet bowl.

Referring to FIG. 1, a double walled toilet 10 of the type used for recreational vehicles has a ventilation orifice 12 that is attached to a conduit 14 leading to the exterior of the vehicle. The conduit can lead to the outside through the wall as shown in the drawing or it can go through the floor. The opening of the orifice is at the back of the toilet. Preferably, the hose has a bend in it at the level of the toilet bowl and held in place by a nylon cable tie. A switch 16 is mounted on the side of the toilet bowl to allow easy access for the person using the toilet to turn the switch on.

In a preferred embodiment, the center of the orifice for the outlet hose is drilled in the center of the top of the toilet about 1 to 3 inches from the edge of the rim, preferably about 1 to 2 inches, most preferably about 1.25 to 1.75 inches from the edge of the rim and hose held in place by a nylon cable tie. It may be necessary to form a relief in the hinged edge of the top to allow the end of the hose to have enough clearance to close.

Similarly, a second similarly sized aperture is defined by the second member and located in the rear wall of the hollow toilet body. This second aperture penetrates the wall, or possibly the floor, of the dwelling where the toilet is located. This aperture is between about one half inch and two inches, preferably about one half inch to about one and one half inches, more preferably between about three quarters of an inch to about one and one quarter inches in diameter. It is greatly preferred that the diameters of the first aperture and the second aperture are the same.

The switch 16 is electrically connected to a blower 18 mounted on the outside of the structure housing the toilet. Usually, in the preferred embodiment, the structure will be a mobile home, or recreational vehicle.

Figure 2:
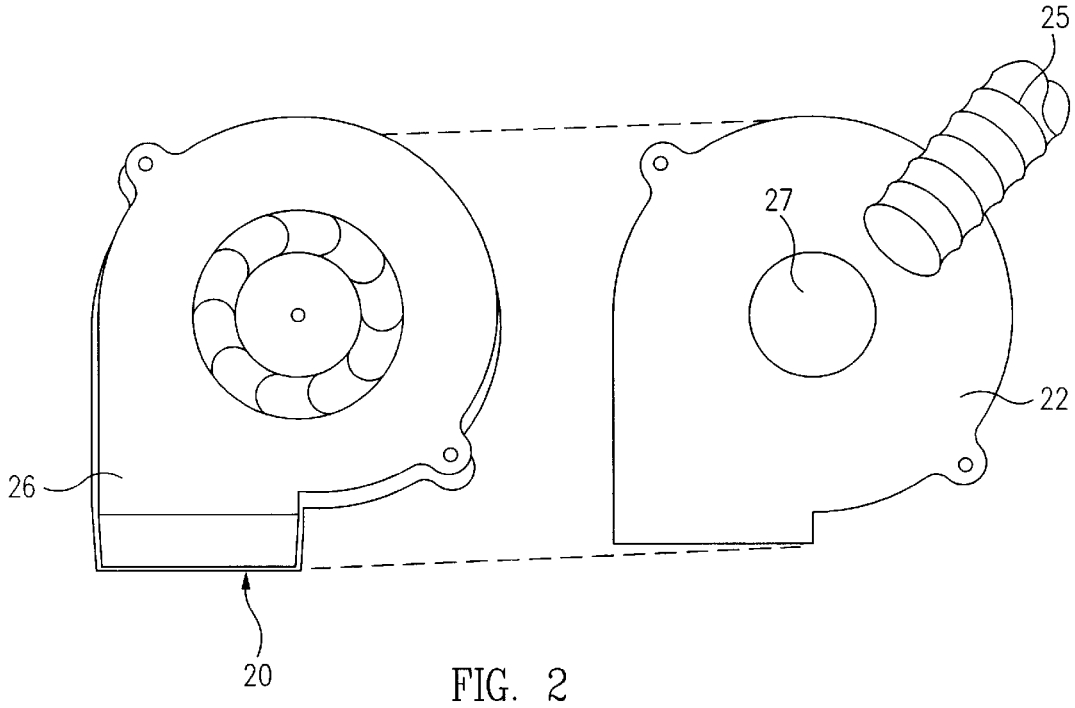
FIG. 2 is a perspective partially exploded view of one preferred blower unit used in this invention.

Referring now to FIG. 2, the blower apparatus 20 has a top member 22, and a blower-motor member 26. The air communicating conduit that passes air to the blower. A flexible tube which acts as an odor conducting conduit 25 connects to the top member 22 by forcing the tube through the receiving hole 27 where it will stay in place by resilient pressure exerted on the side of the receiving hole.

The blower is a conventional blower and draws odors from the toilet bowl into the oriface through the tube to the outside of the structure. Although the blower may be connected to the conduit by a positive means, for example, a nylon cable tie, the preferred way is to snap fit the resilient tube 25 through a receiving hole 27 in the blower cover.

The air communicating conduit passes through the wall or floor of the structure, and then to the blower. The structure has a mounting plate on its outside to allow the conduit to pass through the structure without damaging it permanently. This prevents drafts and thermal loss from the inside of the mobile home to the outside of the mobile home.

In a preferred embodiment, the conduit used is corrugated plastic tubing. Such tubing has the advantage that the tubing is quite flexible without losing its air communicating properties.

The blower is mounted to the wall 30 with at least two sets of screws penetrating the wall or the floor of the trailer. The blower is mounted on the top member 22 or cover.

The toilet body of a typical toilet located inside a mobile vehicle has a front, rear, top and bottom. A bowl is defined by a surface of a first shaped member 32 and an outside surface defined by a second shaped member 34. The two members are separated by a gap or space 36 between them, thereby giving the toilet the approximate look and feel of a standard porcelain toilet. The first member and the second member join at the top of the toilet body to form a flat top surface. A toilet seat 42 (shown in exploded position) fits onto the top of the toilet. A recess 43 in the bottom of the toilet seat allows the ventilation orifice 12 to fit on the top of the toilet.

A flexible tube having a first end and a second end penetrates the first aperture, the ventilation orifice 12. Because of the construction of the mobile home toilet seats, the tube can have a bend at its end and still clear the toilet seat when it is in the sitting position. The tube passes through the gap created by the first surface and the second surface and passes through the second aperture and emerges from the back of the body of the toilet seat.

The tube passes to an outlet or aperture in the body of the mobile home and the second end of the tube emerges on the outside of the vehicle. to the outside of the mobile vehicle. This outlet or aperture is preferably between about one half inch and two inches, preferably about one half inch to about one and one half inches, more preferably between about three quarters of an inch to about one and one quarter inches in diameter. It is generally preferred that the diameters of the first aperture, the second aperture and the outlet to the outside of the vehicle are the same.

A blower 18 is mounted on an outside surface of the mobile vehicle proximate the outlet and the second end of the tube is connected to the blower. The tube now provides a means of vapor communication between the toilet bowl and the outside of the mobile vehicle.

The complete system requires an electric switch 16 in electrical communication with the blower 18. The switch is preferably mounted near the seating area of the toilet. The location of the switch is at the user's convenience, but it is preferred that the switch be located on the side of the toilet body, as shown in FIG. 1. When the user sits on the toilet he may throw the switch and the blower then removes the annoying vapors from the toilet bowl to the outside of the vehicle.

An alternative way of viewing the system of this invention is as a system for removing odors from a mobile home toilet. Inside the mobile vehicle is a toilet having a toilet body. The body of the toilet has a front, rear, top and bottom. The bowl of the toilet is defined by the surface of a first shaped member. The outside surface of the toilet body is defined a second shaped member. The first member is separated from the second member forming a gap. The first member and the second member join at the top of the toilet body to form a flat top surface;

A blower mounted externally to the mobile structure housing the toilet is electrically actuated by the user of the toilet when the user sits down to use of the toilet. The blower is actuated by the user at the user's convenience, and since the blower is in vapor communication via a conduit with the toilet the blower removes the annoying vapors from the vicinity of the toilet.

The vapor communication conduit leads from the blower to the rear of the toilet and there penetrates the outside surface of the toilet bowl, passing through the gap in the toilet body, and further penetrates the toilet body at the flat top surface.

It is preferable that the user of toilets used in mobile home residences sit on the toilet and turn the switch on. Many of the toilets installed in such residences require a dual flushing operation. In such a case, the user switches the blower on when first sitting on the toilet. The user flushes the toilet without rising from the toilet seat thereby trapping odors within the body of the toilet. Water is then added to the empty toilet bowl and the user cleans himself. The user then flushes the toilet a second time while remaining seated to trap odors. After the second flushing, the user rises from the toilet and turns the switch to the blower unit off.

This invention has been described by reference to specific embodiments and examples thereof. One of ordinary skill in the art can readily modify, alter, or change the embodiments and examples. Therefore, the appended claims are intended to encompass all such modifications, alterations, or changes.

I claim:

1. A toilet ventilation apparatus comprising:

a toilet body adapted to be located inside a mobile vehicle having a front, rear, top and bottom, and a bowl defined by a surface of a first shaped member and an outside surface defined by a second shaped member, the first member separated from the second member by a gap, the first member and the second member joined at the top of the toilet body to form a flat top surface; a toilet seat mounted over said flat top surface a first aperture defined by the flat top surface and positioned near the back side of the seat of the toilet;

a second aperture defined by the second member and located in the rear wall of the hollow toilet body;

a tube having a first end and a second end penetrating the first aperture and the second aperture placing the first end of the tube near the seating area of the toilet between the position of the toilet seat in the sitting position, and the flat top surface;

an outlet adapted to be disposed in the mobile vehicle, the tube connected to and passing through the outlet so that the second end of the tube would be on the outside of the vehicle;

a blower adapted to be mounted on an outside surface of the mobile vehicle and connected to the second end of the tube, the tube providing a means of vapor communication between the toilet bowl and the outside of the mobile vehicle; and an electric switch in electrical communication with the blower, mounted near the seating area of the toilet.

2. The toilet of claim 1 wherein the vapor communicating conduit is formed from corrugated plastic tubing.

3. The toilet of claim 1 wherein the switch is mounted on the toilet for convenient use by the user of the toilet.

4. A system for removing odors from a mobile home toilet comprising:

the toilet including a toilet body adapted to be located inside a mobile vehicle having a front, rear, top and bottom, and a bowl defined by a surface of a first shaped member and an outside surface defined by a second shaped member, the first member separated from the second member by a gap, the first member and the second member joined at the top of the toilet body to form a flat top surface;

a blower adapted to be mounted externally to said mobile vehicle, the blower being electrically actuated by a user of the toilet at the beginning of the user's use, proximate in time to when the user sits on the toilet; and a vapor communication conduit connecting the blower and the toilet, the conduit leading to the rear of the toilet and penetrating the outside surface of the toilet bowl, passing through the gap in the toilet body, and penetrating the toilet body at the flat top surface.

5. The system of claim 4 wherein the vapor communicating conduit is formed from corrugated plastic tubing.

6. The system of claim 4 further including a switch for the user to actuate the toilet.

7. The system of claim 6 wherein the switch is mounted on the toilet for convenient use by the user of the toilet.

* * * * *